US010650642B2

(12) United States Patent
Martineck, Sr. et al.

(10) Patent No.: US 10,650,642 B2
(45) Date of Patent: May 12, 2020

(54) LOTTERY TICKET DISPENSER BIN FOR DISPENSING PACKAGED LOTTERY TICKETS

(71) Applicant: Scientific Games International, Inc., Newark, DE (US)

(72) Inventors: Jeffrey D. Martineck, Sr., Alpharetta, GA (US); Timothy Masocol, Woodstock, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 15/818,866

(22) Filed: Nov. 21, 2017

(65) Prior Publication Data

US 2019/0156616 A1 May 23, 2019

(51) Int. Cl.

| | |
|---|---|
| ***G07F 17/32*** | (2006.01) |
| ***B65D 83/08*** | (2006.01) |
| ***G07B 7/00*** | (2006.01) |
| ***G07B 3/04*** | (2006.01) |

(Continued)

(52) U.S. Cl.

CPC ..... *G07F 17/329* (2013.01); *B65D 83/0805* (2013.01); *B65D 83/0894* (2013.01); *G07B 3/04* (2013.01); *G07B 7/00* (2013.01); *G07F 11/68* (2013.01); *G07F 17/3216* (2013.01); *G07F 17/42* (2013.01)

(58) Field of Classification Search

CPC ..... B65D 83/0805; B65D 83/0876; B65D 83/0894; B65D 83/12; G07F 17/329

See application file for complete search history.

(56) References Cited

U.S. PATENT DOCUMENTS 978,052 A * 12/1910 Oehring ..... G07B 3/02 225/13
1,785,815 A * 12/1930 Kurtz, Jr. ..... B42F 17/00 206/559

(Continued)

FOREIGN PATENT DOCUMENTS

| | | |
|---|---|---|
| WO | WO 2016/067057 A1 | 5/1916 |
| WO | WO 00/11615 A1 | 3/2000 |
| WO | WO 2005/050577 A1 | 6/2005 |

OTHER PUBLICATIONS

EP Search Report, dated Feb. 20, 2019.

*Primary Examiner* — Gene O Crawford
*Assistant Examiner* — Kelvin L Randall, Jr.
(74) *Attorney, Agent, or Firm* — Dority & Manning, P.A.

(57) ABSTRACT

A lottery ticket dispenser bin is configured for dispensing interconnected sealed ticket packs, and includes a housing having a front panel with a dispensing slot defined therein and a back panel. The housing has a bottom contour that includes a middle section on which the stack of ticket packs rest in an upright orientation, and a front wall that extends upwards towards the dispensing slot. A hump defines a transition surface between the middle section and the front wall, and an initial contact surface that retains a trailing ticket pack in the middle section as a leading ticket pack is pulled through the dispensing slot. The front wall defines a second contact surface against which the trailing ticket pack is pulled and bent as the leading ticket pack is pulled from the dispensing slot. An insert that defines the bottom contour is also provided for insertion into a ticket bin.

14 Claims, 5 Drawing Sheets

(51) Int. Cl.
*G07F 11/68* (2006.01)
*G07F 17/42* (2006.01)

(56) References Cited

U.S. PATENT DOCUMENTS 2,124,780 A * 7/1938 Keppler ..... B65B 43/26 211/51
3,935,978 A * 2/1976 Arp ..... G07B 3/02 225/15
4,032,004 A * 6/1977 Coates ..... A45C 11/18 206/39.6
4,299,637 A * 11/1981 Oberdeck ..... A63F 3/065 101/483
4,398,708 A * 8/1983 Goldman ..... A63F 3/0645 270/1.01
5,100,038 A 3/1992 Schafer
5,386,934 A 2/1995 Lawrence
6,095,624 A 8/2000 Wilbert
6,135,335 A 10/2000 Shoemaker, Jr.
6,267,262 B1 * 7/2001 Wilner ..... B65D 83/0805 221/45
6,860,447 B2 * 3/2005 Boone ..... A47K 10/36 242/564.1
7,014,065 B2 3/2006 Jensen
7,513,432 B2 4/2009 Chang
7,665,394 B2 2/2010 Roberts et al.
9,150,329 B2 * 10/2015 Watson ..... B65D 21/0209
9,339,121 B2 5/2016 Siciliano et al.
9,505,545 B2 * 11/2016 Watson ..... B65D 21/0209
9,613,337 B1 4/2017 Garrison
9,685,026 B1 6/2017 Garrison
2001/0048013 A1 * 12/2001 Roberts ..... B26F 3/002 225/2
2002/0108962 A1 * 8/2002 Mangin ..... A47K 10/42 221/63
2005/0178810 A1 * 8/2005 Woods ..... G07F 11/68 225/1
2005/0286955 A1 * 12/2005 Weeks ..... B41J 11/70 400/621
2006/0261546 A1 * 11/2006 Payne ..... A63F 3/0605 273/139
2010/0308071 A1 12/2010 Businger
2014/0263373 A1 * 9/2014 Watson ..... B65D 21/0209 220/625
2015/0344213 A1 * 12/2015 Watson ..... B65D 21/0209 206/457
2017/0018148 A1 1/2017 Behm et al.
2017/0291755 A1 * 10/2017 Watson ..... B65D 83/0805
2017/0316620 A1 * 11/2017 Shardlow ..... G07B 3/04

* cited by examiner

LOTTERY TICKET DISPENSER BIN FOR DISPENSING PACKAGED LOTTERY TICKETS

BACKGROUND

Conventional instant scratch-off lottery tickets are generally provided to retail establishments as an accordion stack or roll of interconnected tickets, wherein a perforation line separates adjacent tickets. The stack or roll of tickets is typically placed in a dispenser bin wherein the leading ticket is pulled through a dispensing slot and separated from the upstream ticket along the perforation line. The dispenser bin is generally a closed rectangular structure having an internal space to accommodate the stack or roll of tickets. The dispenser bin may be a component of a larger array that includes a multitude of the bins, as known in the art.

Certain "higher-end" scratch-off lottery tickets are provided wherein each ticket includes multiple panels that are folded into a ticket assembly. Each panel may embody a separate game, or the panels may all relate to play of the same game. Because of the multi-panel folded configuration, the ticket assembly cannot be readily mass produced as interconnected ticket assemblies separated by a perforation line. It is thus a common practice to individually seal each ticket assembly in a continuous film wrapper to define a ticket pack that includes the multi-folded ticket assembly sealed within the film, wherein adjacent ticket packs are separated by a perforation line in the sealed film section between the adjacent ticket packs. These sealed ticket packs are typically provided to retailers in an accordion-stacked package.

However, problems exist in dispensing the stacked ticket packs from the conventional dispenser bins discussed above. The ticket packs tend to stick together within the bin, which can result in the retail clerk unintentionally pulling two or more tickets at the same time. In addition, because of their thickness and general rigidity, the interconnected ticket packs do not easily conform to the exit path through the dispensing slot in the dispenser, which creates tension on the ticket packs and a significant risk of premature separation of the ticket packs within the bin.

The industry would benefit from a lottery ticket dispenser bin that enables dispensing interconnected ticket packs in an improved and reliable manner. A dispenser bin that can be readily converted from dispensing conventional interconnected tickets to dispensing interconnected sealed ticket packs would also be beneficial.

SUMMARY

Objects and advantages of the invention will be set forth in part in the following description, or may be obvious from the description, or may be learned through practice of the invention.

In accordance with aspects of the invention, a lottery ticket dispenser bin is provided for dispensing interconnected sealed ticket packs. The bin may be a stand-alone functional unit, or may be a component of a larger dispenser array wherein multiple ones of the bins are stacked and connected. The bin includes a housing that defines an internal space for receipt of a folded stack of the interconnected sealed ticket packs. The housing may be made of any suitable material, such as a transparent plastic, and includes a front panel with a dispensing slot defined therein through which the interconnected ticket packs are pulled. The housing includes a unique bottom contour that is designed to facilitate dispensing of the interconnected sealed ticket packs.

In particular, the bottom contour of the housing includes a middle section on which the folded stack of ticket packs rest in an upright orientation. A front wall extends upwards towards the dispensing slot, and a hump defines a transition surface between the middle section and the front wall. The hump also defines an initial contact surface that retains a trailing ticket pack in the middle section as a leading ticket pack is pulled through the dispensing slot. The front wall defines a second contact surface against which the trailing ticket pack is pulled and bent as the leading ticket pack is pulled further from the dispensing slot.

In a particular embodiment, the bottom contour is formed integrally with the housing and is permanent within the housing. For example, the bottom contour may be integrally molded with a bottom panel or wall of the housing.

In another embodiment, the bottom contour is formed on an insert that is separate from and insertable into the housing. This embodiment is particularly useful in that a conventional dispenser bin can be readily converted for dispensing the interconnected sealed ticket packs simply by placing the insert into the bin housing. The insert may be a single component, such a single molded unit. In an alternate embodiment, the insert may comprise multiple components, such as a front component and a back component, wherein the middle section of the bottom contour is defined by a bottom panel of the housing on which the front and back components rest.

In various embodiments, the middle section is a flat horizontal section, and the front wall is angled away from the middle section towards the dispensing slot. The front wall may include a radiused (e.g. rounded) top that defines the second contact surface against which the ticket packs are pulled during the dispense process.

The bottom contour may further include a back wall that extends upward from the middle section at an angle towards the back panel of the housing. The back wall defines a surface against which the stack of ticket packs lean when they are placed in the middle section such that a bottom of the ticket packs are oriented towards the front wall. The degree of this leaning orientation is determined (in part) by the slope and height of the back wall and, in this regard, the front wall may have a greater vertical height than the back wall.

In a certain embodiment, the transition surface of the hump comprises a convex surface between the middle section and the front wall. This curved surface defines a stop against which the bottom of the ticket packs engage when placed in the middle section and also enables the ticket packs that are pulled up onto the hump during dispensing to slide back into the middle section.

The present invention also encompasses an insert as a stand-alone component, wherein the insert is insertable into a housing of a lottery ticket bin and configured to convert the bin for dispensing a folded stack of interconnected sealed ticket packs, as discussed above. The insert includes an upper surface that defines a bottom contour of the housing when the insert is placed into the housing. The upper surface of the insert has a middle section on which the folded stack of ticket packs rest in an upright orientation in use of the insert within the dispenser bin. A front wall of the insert extends upwards away from the middle section and towards a dispensing slot in a front panel of the housing when the insert is placed in the housing. The insert includes a hump that defines a transition surface between the middle section and the front wall and an initial contact surface that retains a trailing ticket pack in the middle section as a leading ticket pack is pulled through the dispensing slot. The front wall defines a second contact surface against which the trailing ticket pack is pulled and bent as the leading ticket pack is pulled further from the dispensing slot.

The middle section of the insert may be a flat horizontal section, or may include other surface contours, such as a wavy or undulating surface.

The front wall of the insert may include a radiused top that defines the second contact surface and facilitates bending of the trailing ticket pack.

The insert may include a back wall that extends upward from the middle section at an angle towards a back panel of the housing when the insert is placed in the housing. The back wall defines a surface against which the stack of ticket packs lean when they are placed in the middle section such that a bottom of the ticket packs are oriented towards the front wall. The degree of this leaning orientation is determined (in part) by the slope and height of the back wall and, in this regard, the front wall may have a greater vertical height than the back wall.

In certain embodiments of the insert, the hump has a convex surface between the middle section and the front wall that enables the ticket packs that are pulled up onto the hump during dispensing to slide back into the middle section.

The present invention also encompasses an insert assembly for a lottery ticket dispenser bin, wherein the insert assembly is insertable into a housing of the bin and configured to convert the bin for dispensing a folded stack of interconnected sealed ticket packs. The insert assembly includes a front component and a separate back component, the front and back components insertable into the bin housing in a spaced-apart manner such that a middle section of a bottom panel of the housing is exposed between the front and back components. This middle section defines a surface on which the folded stack of ticket packs rest in an upright orientation in the bin housing. The front component defines a front wall that extends upwards towards a dispensing slot in a front panel of the housing when the insert assembly is placed in the housing. The front component further comprises a hump that defines a transition surface between the middle section and the front wall, the hump defining an initial contact surface that retains a trailing ticket pack in the middle section as a leading ticket pack is pulled through the dispensing slot. The front wall also defines a second contact surface against which the trailing ticket pack is pulled and bent as the leading ticket pack is pulled further from the dispensing slot. The back component defines a back wall that extends upwards and at an angle away from the front component.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
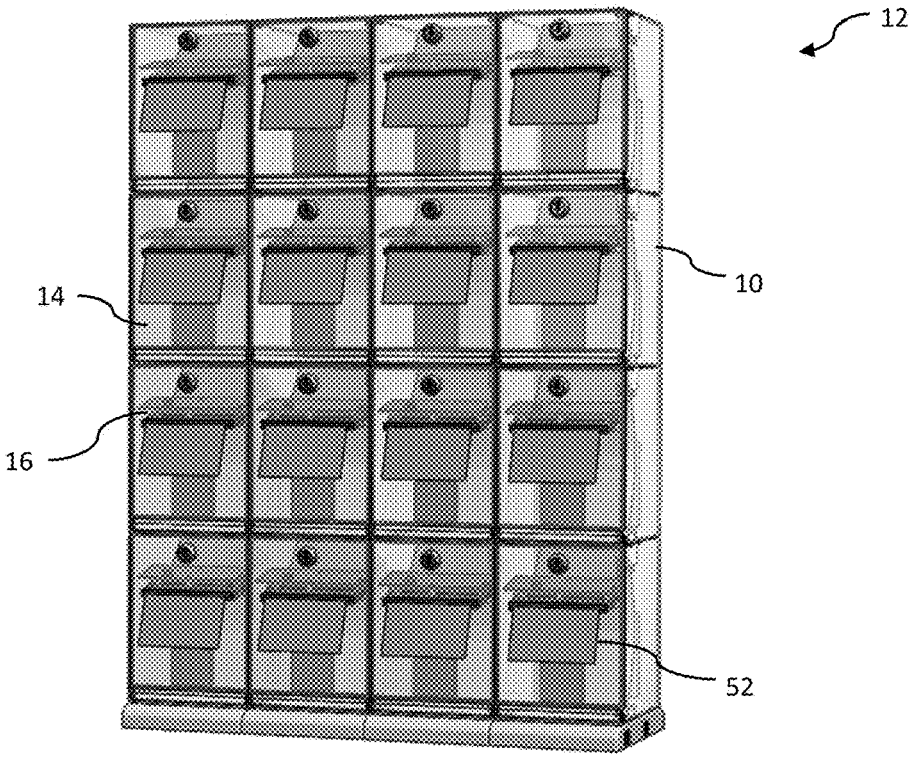
FIG. 1 is a perspective view of a lottery ticket dispenser array wherein the individual bins within the array are configured in accordance with the present invention or can receive inserts in accordance with the invention.
Figure 2A:
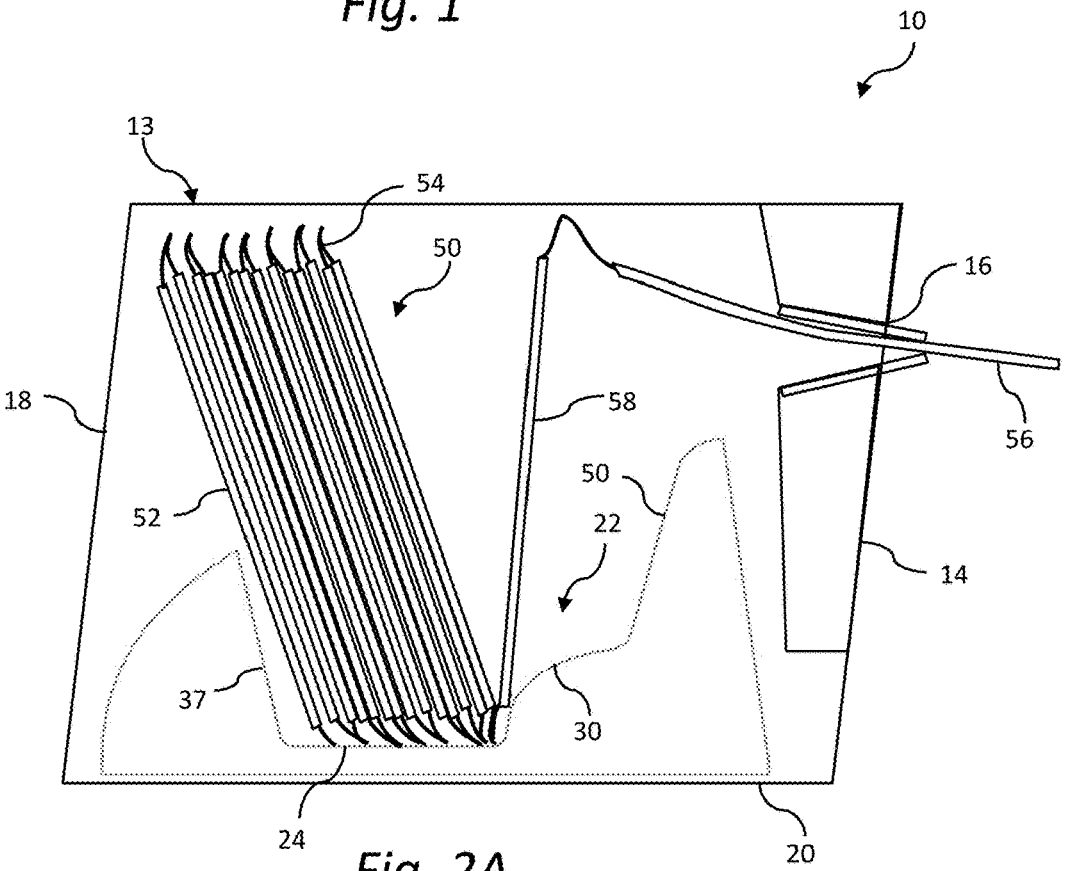
FIGS. 2A through 2F are sequential operational views of a lottery ticket dispenser bin or insert in accordance with aspects of the invention.

Referring to FIG. 1, a lottery ticket dispenser array 12 is depicted and includes a plurality of individual ticket bins 10. Each bin 10 serves to hold a stack or roll of interconnected scratch-off lottery tickets, wherein a lead ticket extends through a dispensing slot 16 defined in a front panel 14 of each bin. A clerk pulls the lead ticket from the respective bin 10 until the desired number of tickets have been withdrawn, wherein the tickets extending from the bin are then separated from a trailing ticket in the bin along a perforation line between the tickets, as in well-known in the art. According to the present invention, the bins 10 are specifically designed to dispense interconnected lottery ticket packs 52 (FIG. 2A). As discussed above, such ticket packs 52 typically include a folded, multi-panel lottery ticket that is sealed within a film pouch. The film pouches are interconnected by sealed sections 54 between adjacent ticket packs 52. A perforation line is provided in the sealed sections so that the ticket packs 52 can be readily separated after being drawn from the bin 10.

Referring to FIG. 2A, the bin 10 includes a housing 13 that defines an internal space for receipt of a folded stack 50 of the interconnected sealed ticket packs 52. The housing 13 may be made of any suitable material, such as a transparent plastic, and includes a front panel 14 with a dispensing slot 16 defined therein through which the interconnected ticket packs 52 are pulled by a clerk. In an automated embodiment, the bin 10 may include an internal motorized drive mechanism that dispenses the ticket packs 52 through the dispensing slot 16. The housing 13 includes a back panel 18 and a bottom panel 20. It should be readily appreciated that the housing 13 can have any desired shape and dimensions depending on the ticket packs 52 to be dispensed therefrom.

Figure 2B:
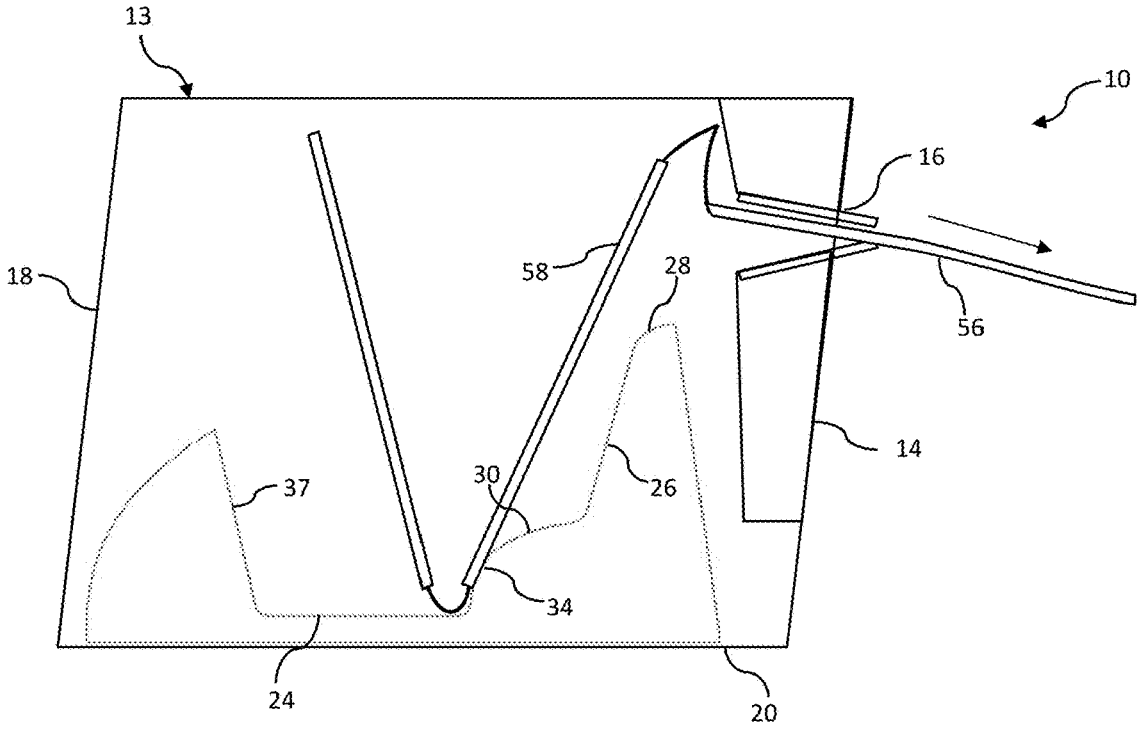

The housing 13 includes a unique bottom contour 22 that is designed to facilitate dispensing of the interconnected sealed ticket packs 52. In this regard, the internal bottom contour 22 of the housing 13 includes a middle section 24 on which the folded stack 50 of ticket packs 52 rest in an upright orientation within the housing 13, as depicted in FIG. 2A. A front wall 26 extends upwards towards the dispensing slot 16, and a hump 30 defines a transition surface between the middle section 24 and the front wall 26. As explained in more detail below, the hump 30 also defines an initial contact surface 34 that retains a trailing ticket pack 58 in the middle section as a leading ticket pack 56 is pulled through the dispensing slot 16, as depicted in FIG. 2B. The front wall 26 also defines a second contact surface 36 against which the trailing ticket pack 58 is pulled and bent as the leading ticket pack 56 is pulled further from the dispensing slot 16, as seen in FIG. 2D.

The bottom contour 22 may be formed as an integral, permanent part of the housing 13. For example, the bottom contour 22 may be integrally molded into the bottom panel 20 of the housing.

In another embodiment discussed in greater detail below, the bottom contour 22 is formed on an insert 38 that is separate from and insertable into the housing 13. This embodiment is particularly useful in that a conventional dispenser bin can be readily converted for dispensing the interconnected sealed ticket packs 50 simply by placing the insert 38 into the bin housing 13. The insert may be a single component (FIG. 3), such a single molded unit, or may comprise multiple components (FIG. 4).

In the depicted embodiments, the middle section 24 is a flat horizontal section against which the bottom (the sealed sections 54) of the ticket packs 52 rest, and the front wall 26 is angled upwards and away from the middle section 24 towards the dispensing slot 16. The front wall 26 may include a radiused (e.g. rounded) top 28 that defines the second contact surface 36 against which the ticket packs 52 are pulled during the dispense process (FIG. 2D).

The bottom contour 22 may further include a back wall 37 that extends upward from the middle section 24 at an angle towards the back panel 18 of the housing 13. The back wall 37 defines a surface against which the stack 50 of ticket packs 52 lean when they are placed in an upright orientation in the middle section 24, as shown in FIG. 2A, such that a bottom of the ticket packs 52 are oriented towards the front wall 26. This leaning orientation of the stack 50 aids in preventing the individual ticket packs 52 from sticking to each other. The degree of the leaning orientation is determined (in part) by the slope and height of the back wall 37 and, in this regard, the front wall 26 may have a greater vertical height than the back wall 37.

In the illustrated embodiments, the transition surface of the hump 30 is a convex surface between the middle section 24 and the front wall 26. This curved surface defines a stop against which the bottom of the ticket packs 52 engage when placed in the middle section 24, as depicted in FIG. 2A, and also enables the ticket packs that are pulled up onto the hump 30 during dispensing to slide back into the middle section 24, which also aids in preventing multiple ticket packs 52 from being pulled towards the dispensing slot 16 at the same time.

FIG. 2A depicts a static condition of the ticket pack 50 loaded into the bin housing 13. The leading ticket pack 56 extends out through the dispensing slot 16 and the adjacent trailing ticket pack 58 is pulled into a more upright orientation relative to the remaining ticket packs 52 in the stack 50.

FIG. 2B depicts a start of the dispense process wherein the leading ticket pack 56 is being pulled from the dispensing slot 16, as indicate by the arrow. The trailing ticket 58 is pulled forward while the bottom portion of the trailing ticket 58 engages against the first contact surface 34 defined by the hump 30.

Figure 2C:
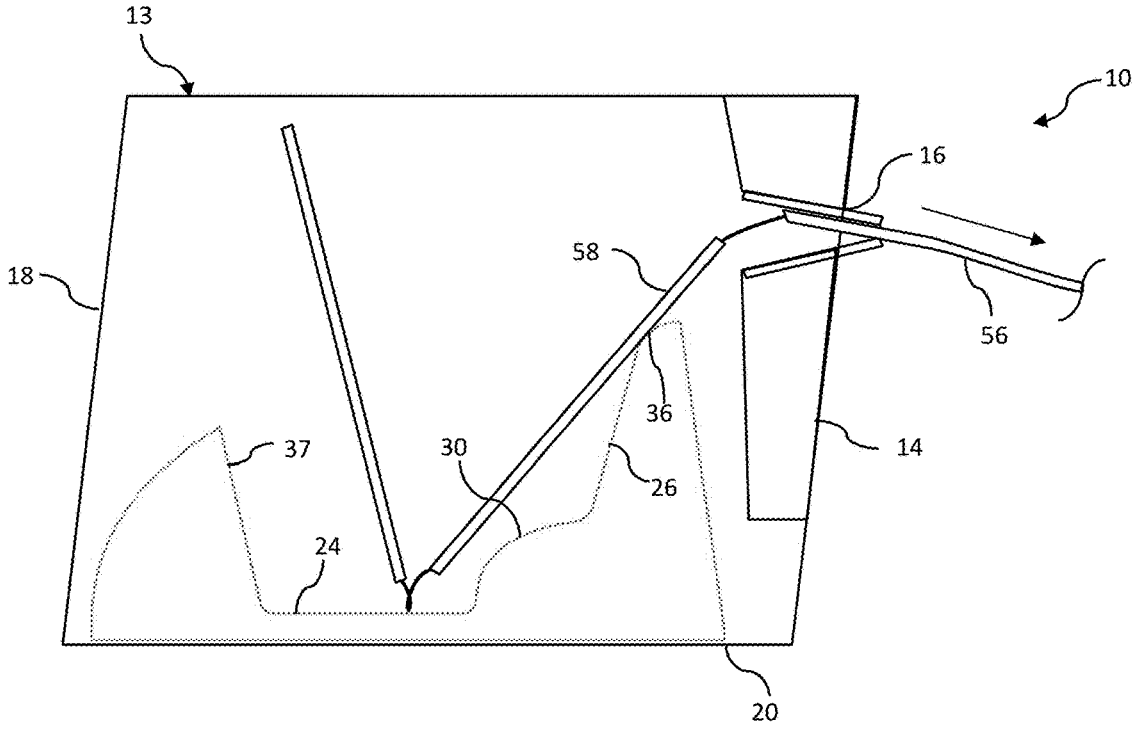
Figure 2D:
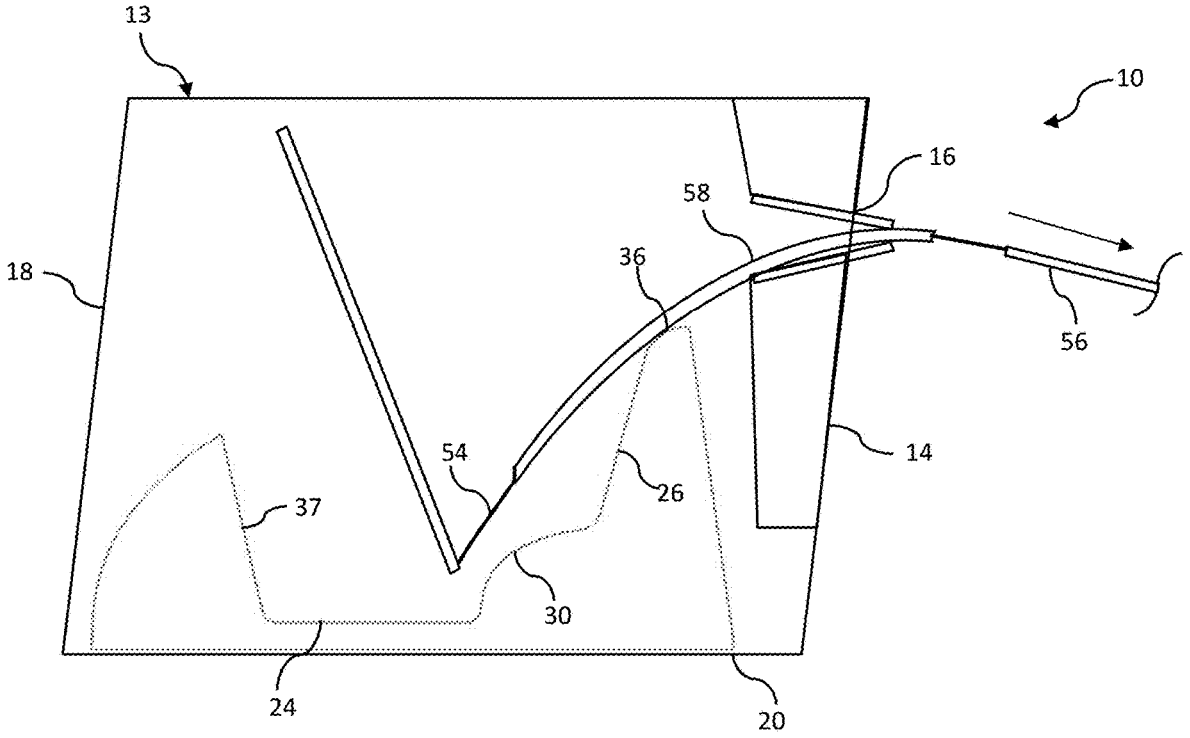

FIG. 2C depicts further pulling of the leading ticket pack 56, which causes the trailing ticket pack 58 to "kick out". The top portion of the trailing ticket pack 58 engages against the second contact surface 36 defined by the top 28 of the front wall 26 while the bottom portion of the trailing ticket pack moves away and disengages from the first contact surface 34.

FIG. 2D depicts the trailing ticket pack 58 being pulled through the dispensing slot 16. The ticket pack 58 bends around the second contact surface 36, which significantly reduces tension on the ticket pack 58 created by the negative angle of the dispensing slot 16.

Figure 2E:
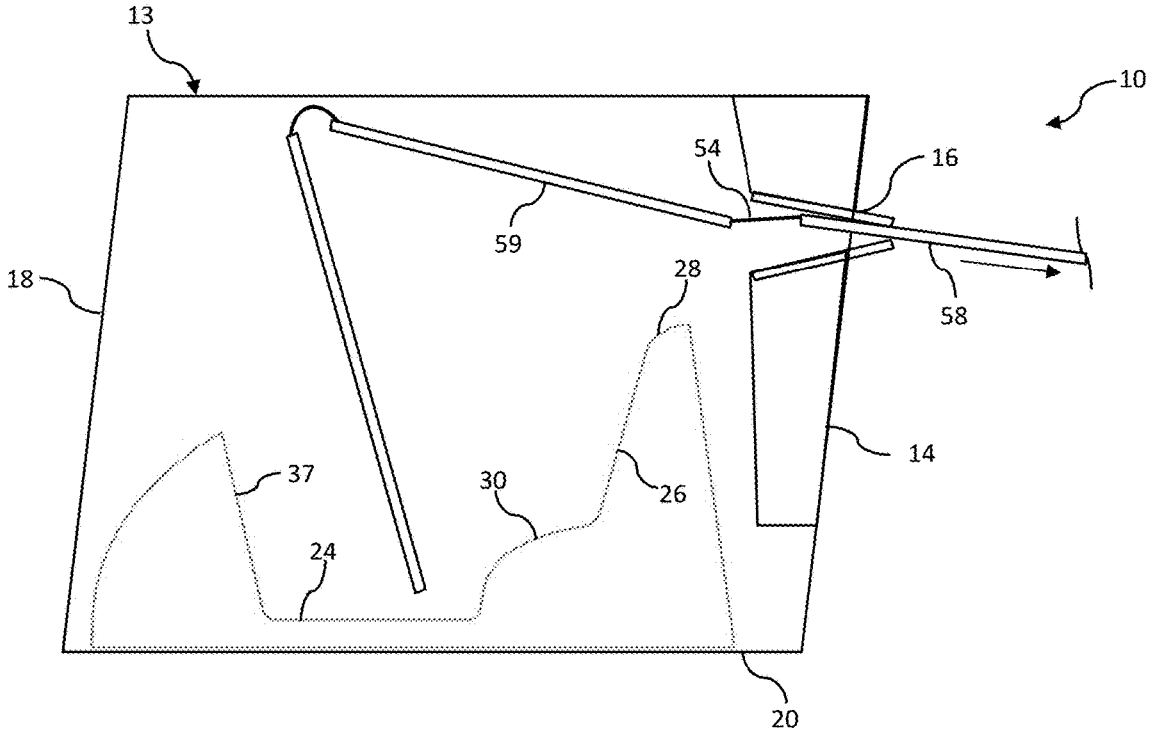

FIG. 2E depicts the trailing ticket pack 58 as it is pulled further through the dispensing slot 16. The bottom of the second trailing ticket pack 59 (attached to the first trailing ticket pack 58) swings upwards towards the dispensing slot 16 while clearing the front wall 26 and hump 30 in the process.

Figure 2F:
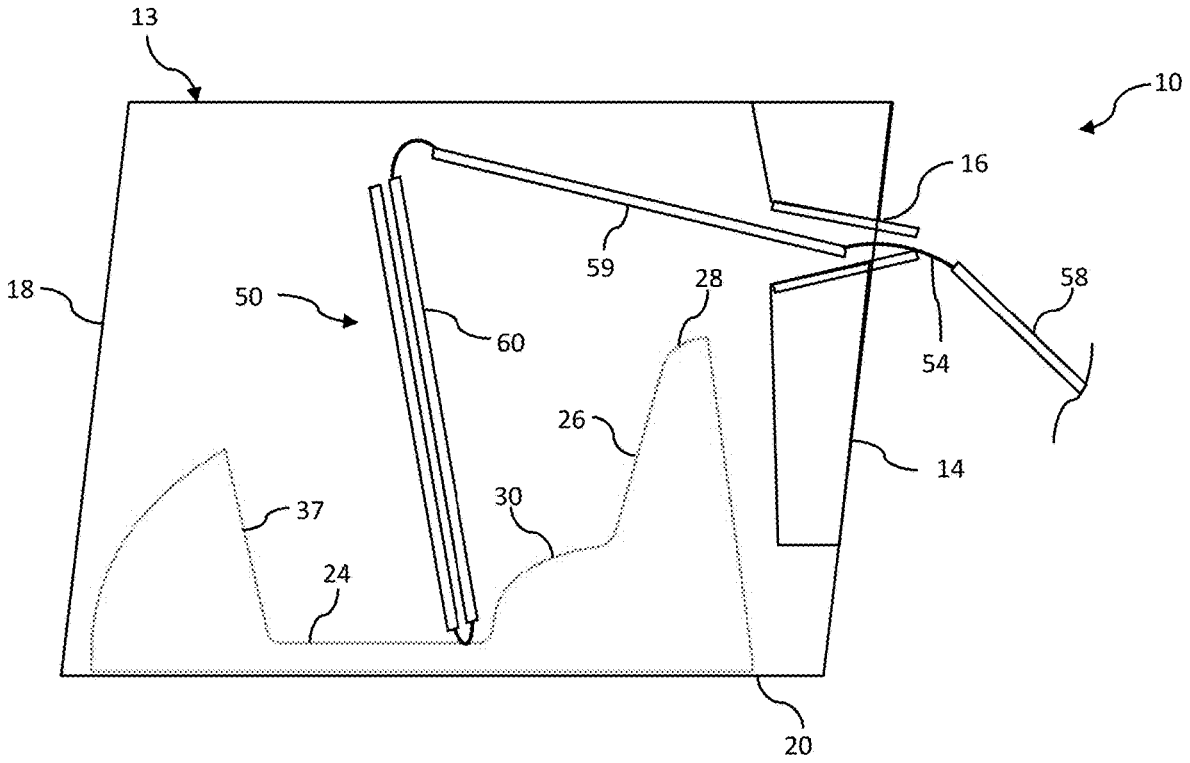

FIG. 2F depicts the leading trailing pack 58 extending from the dispensing slot 16 with the attached second trailing pack 59. The leading ticket pack 56 (not seen in FIG. 2F) has been separated by the clerk via a perforation line in the sealed section 54 between the ticket packs 56 and 58, and the trailing ticket pack 58 becomes a new leading trailing pack. In a subsequent dispense cycle, the second trailing ticket pack 59 will be pulled further through the dispensing slot 16 and the third trailing ticket pact 60 will assume the orientation of ticket pack 58 depicted in FIG. 2A, wherein the process described above repeats.

Figure 3:
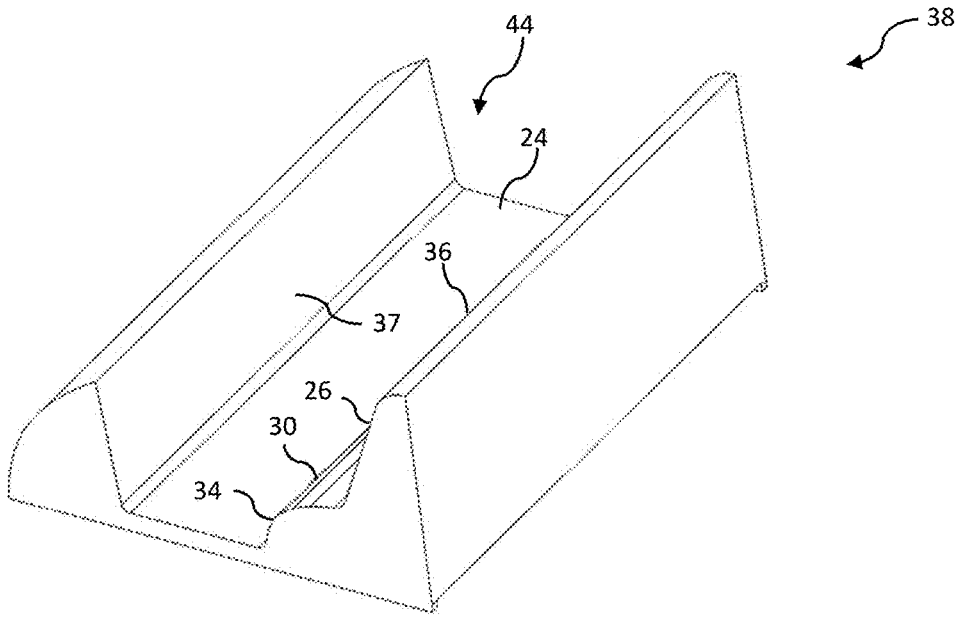
FIG. 3 is a perspective view of an insert designed for placement within a conventional lottery ticket dispenser bin for converging the bin for dispensing a stack of folded interconnected ticket packs.
Figure 4:
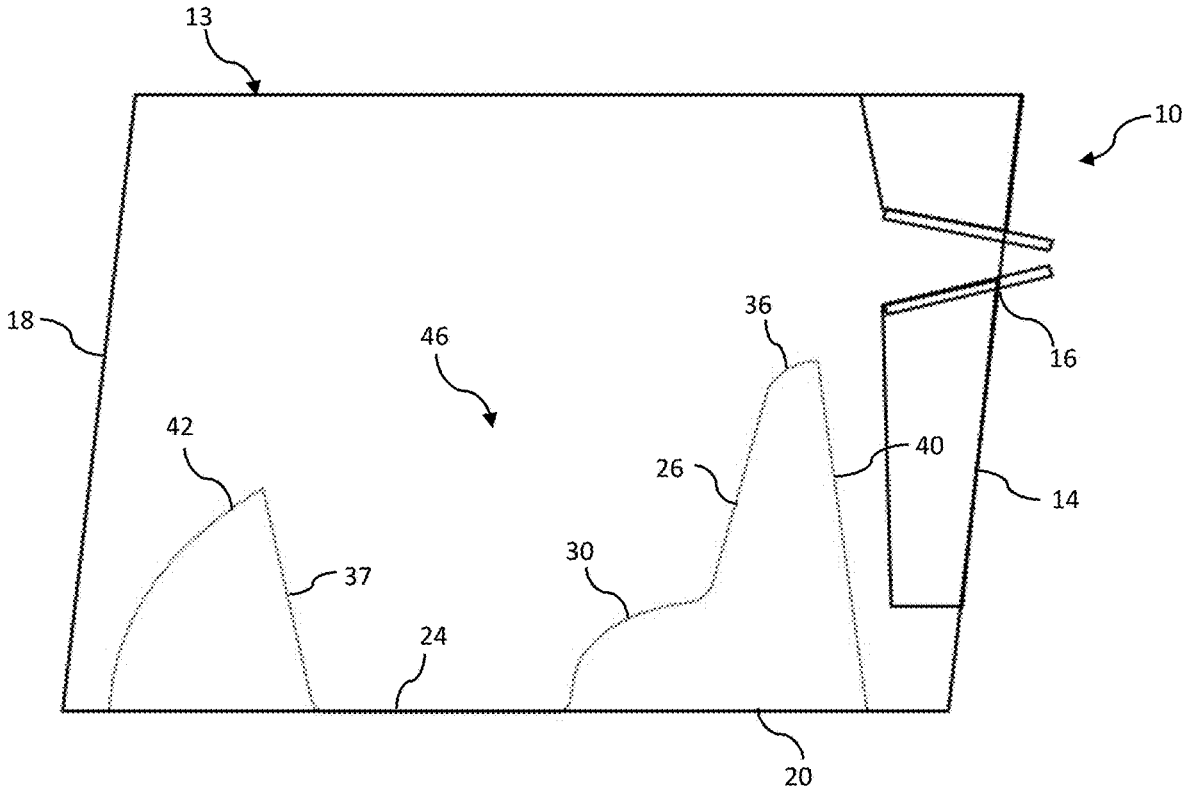
FIG. 4 is a perspective view of a multi-component insert configuration.

Referring to FIG. 3, the present invention also encompasses an insert 38 as a stand-alone component, wherein the insert 38 is insertable into a housing 13 of a lottery ticket bin 10 to convert the bin for dispensing a folded stack 50 of interconnected sealed ticket packs 52, as discussed above. The insert 38 includes an upper surface 44 that defines a bottom contour 22 of the housing 13 when the insert 38 is placed into the housing. The upper surface 44 of the insert 38 has a middle section 24 on which the folded stack 50 of ticket packs 52 rest in an upright orientation in use of the insert 38 within the dispenser bin 10. A front wall 26 of the insert 38 extends upwards away from the middle section 24 and towards a dispensing slot in a front panel of the housing when the insert 38 is placed in the housing. The insert 38 includes a hump 30 that defines a transition surface between the middle section 24 and the front wall 26, as well as an initial contact surface 34 that retains a trailing ticket pack in the middle section 24 as a leading ticket pack is pulled through the dispensing slot in the housing. The front wall 26 defines a second contact surface 36 against which the trailing ticket pack is pulled and bent as the leading ticket pack is pulled further from the dispensing slot, as discussed above.

The discussion of the bottom contour 22 in FIGS. 2A through 2F pertains to the insert 38 of FIG. 3, and is incorporated herein.

Referring to FIG. 4, the present invention also encompasses an insert assembly 46 for a lottery ticket dispenser bin 10, wherein the insert assembly 46 is insertable into a housing 13 of the bin 10 and to convert the bin 10 for dispensing a folded stack of interconnected sealed ticket packs. The insert assembly 46 includes a front component 40 and a separate back component 42, the front and back components 40, 42 are insertable into the bin housing 13 in a spaced-apart manner such that a middle section 24 of the bottom contour 22 is defined by an exposed portion of the bottom panel 20 of the housing 13 between the front 40 and back 42 components. As discussed above, this middle section 24 defines a surface on which the folded stack of ticket packs rest in an upright orientation in the bin housing 13. The front component 40 defines the front wall 26 that extends upwards towards a dispensing slot 16 in the front panel 14 of the housing 13 when the insert assembly 38 is placed in the housing 13. The front component 40 further comprises the hump 30 that defines a transition surface between the middle section 24 and the front wall 26, as well as the initial contact surface 34 that retains a trailing ticket pack in the middle section 24 as a leading ticket pack is pulled through the dispensing slot 16, as discussed above. The front wall 26 also defines the second contact surface 36 against which the trailing ticket pack is pulled and bent as the leading ticket pack is pulled further from the dispensing slot 16. The back component 42 defines the back wall 37 that extends upwards and at an angle away from the front component 40.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser bin system configured for dispensing interconnected sealed ticket packs, comprising:

a plurality of interconnected sealed ticket packs, wherein each ticket pack comprises a lottery ticket within a sealed film pouch, the ticket packs fan-folded at adjacent ends of the sealed film pouches into a flat stack;

a bin comprising a housing that defines an internal space in which flat stack of ticket packs is stored in an upright and standing orientation, the housing further comprising a front panel with a dispensing slot defined therein and a back panel;

the housing comprising a bottom contour, the bottom contour further comprising:

a middle section on which the flat stack of ticket packs rest in the upright standing orientation;

a back wall extending upward from the middle section at an angle away from the middle section towards the back panel of the housing;

a front wall spaced from the front panel of the housing and extending upwards towards the dispensing slot;

a hump defining a transition surface between the middle section and the front wall, wherein the front wall extends from the hump, the hump defining an initial contact surface that engages and retains a lower portion of a trailing ticket pack in the middle section as a leading ticket pack is pulled through the dispensing slot; and the front wall defining a second contact surface against which an upper portion of the trailing ticket pack is pulled and bent as the leading ticket pack is pulled further from the dispensing slot and the lower portion of the trailing ticket pack disengages from the hump.

2. The lottery ticket dispenser bin as in claim 1, wherein the bottom contour is formed integrally with the housing and is permanent within the housing.

3. The lottery ticket dispenser bin as in claim 1, wherein the bottom contour is formed on an insert, the insert insertable into and removable from the housing.

4. The lottery ticket dispenser bin as in claim 1, wherein the insert comprises multiple components.

5. The lottery ticket dispenser bin as in claim 1, wherein the middle section is a flat horizontal section, and the front wall is angled towards the dispensing slot.

6. The lottery ticket dispenser bin as in claim 5, wherein the front wall comprises a radiused top that defines the second contact surface.

7. The lottery ticket dispenser bin as in claim 1, wherein the front wall has a greater vertical height in the housing than the back wall of the contour.

8. The lottery ticket dispenser bin as in claim 1, wherein the transition surface of the hump comprises a convex surface between the middle section and the front wall that enables the ticket packs that are pulled up onto the hump during dispensing to slide back into the middle section.

9. The lottery ticket dispenser bin as in claim 1, wherein the bottom contour is defined on an insert that is placed into the housing.

10. A removable insert for a lottery ticket dispenser bin, the insert insertable into a housing of the bin and configured to convert the bin for dispensing a flat stack of interconnected and fan-folded sealed ticket packs, the insert comprising:

an upper surface that defines a bottom contour of the housing when the insert is placed into the housing, the upper surface further comprising:

a middle section on which the flat stack of ticket packs rest in an upright standing orientation;

a back wall extending upward from the middle section at an angle away from the middle section;

a front wall that is spaced from the middle section a distance such that the front wall is spaced from a front panel of the housing when the insert is placed into the housing, the front wall extending upwards towards a dispensing slot in the front panel of the housing when the insert is placed in the housing;

a hump defining a transition surface between the middle section and the front wall, wherein the front wall extends from the hump, the hump defining an initial contact surface that engages and retains a lower portion of a trailing ticket pack in the middle section as a leading ticket pack is pulled through the dispensing slot; and the front wall defining a second contact surface against which an upper portion of the trailing ticket pack is pulled and bent as the leading ticket pack is pulled further from the dispensing slot and the lower portion of the trailing ticket pack disengages from the hump.

11. The insert as in claim 10, the middle section is a flat horizontal section, and the front wall is angled towards the dispensing slot.

12. The insert as in claim 11, wherein the front wall comprises a radiused top that defines the second contact surface.

13. The insert as in claim 10, wherein the front wall has a greater vertical height in the housing than the back wall.

14. The insert as in claim 10, wherein the transition surface of the hump comprises a convex surface between the middle section and the front wall that enables the ticket packs that are pulled up onto the hump during dispensing to slide back into the middle section.

* * * * *